United States Patent [19]

De Santis et al.

[11] 4,006,434

[45] Feb. 1, 1977

[54] MICROSTRIP CIRCULATOR OPERATING IN THE PERIPHERAL MODE AND HAVING NON-UNIFORM BIASING MEANS

[75] Inventors: Pietro De Santis; Fioravante Pucci, both of Rome, Italy

[73] Assignee: Selenia-Industrie Elettroniche Associate S.p.A., Rome, Italy

[22] Filed: June 9, 1975

[21] Appl. No.: 585,189

Related U.S. Application Data

[63] Continuation of Ser. No. 438,364, Jan. 31, 1974, abandoned.

[30] Foreign Application Priority Data

Jan. 31, 1973 Italy ..... 48000/73

[52] U.S. Cl. ..... 333/1.1; 333/84 M

[51] Int. Cl.[2] ..... H01P 1/38

[58] Field of Search ..... 333/1.1, 24.1

[56] References Cited

UNITED STATES PATENTS

| | | | |
|---|---|---|---|
| 3,456,213 | 7/1969 | Hershenov | 333/1.1 |
| 3,555,459 | 1/1971 | Anderson | 333/1.1 |
| 3,617,951 | 11/1971 | Anderson | 333/1.1 |

OTHER PUBLICATIONS

De Santis et al., Novel Type of M.I.C. Symmetrical 3–Port Circulator, Electronics Letters, Jan. 13, 1972, vol. 8, No. 1, pp. 12, 13.

*Primary Examiner*—Paul L. Gensler

[57] ABSTRACT

There are provided for radar applications microwave multigate junctions that utilize excitation of peripheral modes. The conductor structure is applied to a ferrite, that is magnetized perpendicularly to the plane of its mass. The arrangement presents, through adaptation between the TEM mode and the peripheral mode, an effective distribution of the permeability of the ferrite which is spatially non-uniform in correspondence with tapering zones of the conductor which serves for the coupling of transmission lines.

3 Claims, 9 Drawing Figures

MICROSTRIP CIRCULATOR OPERATING IN THE PERIPHERAL MODE AND HAVING NON-UNIFORM BIASING MEANS

This is a Continuation of application Ser. No. 438,364 filed Jan. 31, 1974 now abandoned.

BACKGROUND OF THE INVENTION

The present invention relates to an improvement in microwave miltigate junctions or circulators especially for radar applications.

More specifically, the present invention has as its object to provide multigate junctions in which the adaptation between the TEM (Transverse Electro Magnetic Wave) modes of propagation along the transmission lines and the peripheral modes are accomplished by means of magnetic tapering.

As is well known in the prior practice in the field of application of microwave devices, and even more especially in that of the radar applications, there have been proposed multigate junction systems in which the width of the useful band, however, was not sufficient, in many cases to allow satisfactory service. In order to eliminate or substantially to reduce that drawback, there have been suggested and there have been described in the literature, as for example U.S. Pat. No. 3,555,459, systems in which the widening of the useful band is obtained through the elimination of the undesired modes by dissipation of the energy. Such a solution, however, means an appreciable loss of useful signal. Another solution of the problem of attempting to improve the efficiency of the system, is based on the use of very gradual "taperings" in the adaption geometry between the transmission lines and the peripheral mode structure. In this case, also, the solution is not free from drawbacks, because it deprives the component of those miniaturization characteristics which, on the contrary, it must have.

The principal object of the present invention is that of providing a multigate junction, which possesses a satisfactory width of useful band.

Another object of the present invention is that of providing a component in which the losses of energy are appreciably reduced.

Still another object of the present invention is that of providing a component the dimensions of which are appreciably reduced.

The described embodiment of the present invention makes possible the simultaneous achieving of the stated objects, eliminating, in the meanwhile, the disadvantages of the prior art techniques, which have been mentioned. Recently, the use of peripheral waves, or peripheral modes, in the field of ferrite devices operating at microwave frequency, has excited much interest. These are discussed for example in: Hines N.E., "A New microstrip Isolater and Its Application to Distribution Diode amplification," IEEE G-NIT 1970. International Microwave Symposium, Newport Beach (Cal.), Digest of papers, pp. 304–307; Hines M.E. "Ferrite Phase Shifters and Multiport Circulators in Microstrip and Strip Line," IEEE G-MTT 1971, International Microwave Symposium, Washington D.C. Digest of papers, pp. 108–109; De Santis F., Pucci F., "Novel Type of M.I.C. Symmetrical 3-Port Circulator" electronics Letters Vol. 8, No. 1, pp. 12–13, January, 1972; De Santis P. Pucci F., "Experiments on the Optimization of a Novel M.I.C. Symmetrical Three Port Circulator," IEEE G-MTT 1972, International Microwave Symposium, Chicago, Illinois, Digest of papers, pp. 238–240.

In order to better illustrate the significance of the present invention, there will briefly be summarized the characteristics of the functioning of the peripheral wave devices. A peripheral wave is a wave which propagates itself along the edge of the radio-frequency conductor in a microstrip on a ferrite member magnetized perpendicularly to the plane of the mass. This is a unidirectional wave in that for a given orientation of the magnetic field of polarization, it has a given manner or direction of propagation. By reversing the orientation of the magnetic field of polarization, there is also reversed the line or direction of propagation. This property of being unidirectional may be taken advantage of to build non-reciprocal multigate junctions or circulators. In a typical structure, the electromagnetic energy is introduced into one gate and withdrawn from the successive gates through lines of transmission (for example isotropic lines in microstrip, in line with strip or in coaxial conductor the characteristic impedance of which must be suited to the impedance of the peripheral wave circuit. This adaptation of impedance generally is obtained by means of tapered sections in the microstrip. In other words it can be said that the TEM waves or modes which propagate themselves along the transmission lines are converted into peripheral waves or modes through the use of tapered arms in the microstrip.

It is the specific object of the present invention to provide a peripheral wave or mode excited multigate junction having a tapered arm conductive structure on a magnetized ferrite, magnetized perpendicularly to the plane of its mass, characterized by the fact that it presents, through the adaptation between the TEM wave or mode and said peripheral wave or mode, a distribution of the effective permeability of the ferrite, spatially non-uniform in correspondence with the tapering zones or arms which are adapted for connection with the transmission lines. Henceforth, such spatial non-uniform distribution of the magnetic permeability will be indicated by the expression "magnetic tapering." Said magnetic tapering is obtained, according to the present invention, through the use of magnetic fields, of spatially non-uniform polarization. Said magnetic fields of polarization in their turn are obtained by the use of permanent magnets and possibly with the addition of a ferro-magnetic element inserted into the magnetic circuit.

The invention will now be described with reference to the preferred forms of execution, by reference to the accompanying drawings, in which:

FIG. 1*a* and 1*b* represent, in principle, the manner or direction of rotation of a peripheral wave which propagates itself on the edge of a microstrip conductor that is disposed on a ferrite slab which is magnetized perpendicularly to the plane of the mass, as a function of the orientation of the magnetic field.

FIG. 2*a* schematically represents a microstrip multigate junction, while FIG. 2*b* shows a microstrip multigate junction which includes extending tapered arms for connection to transmission lines.

Figure 3:
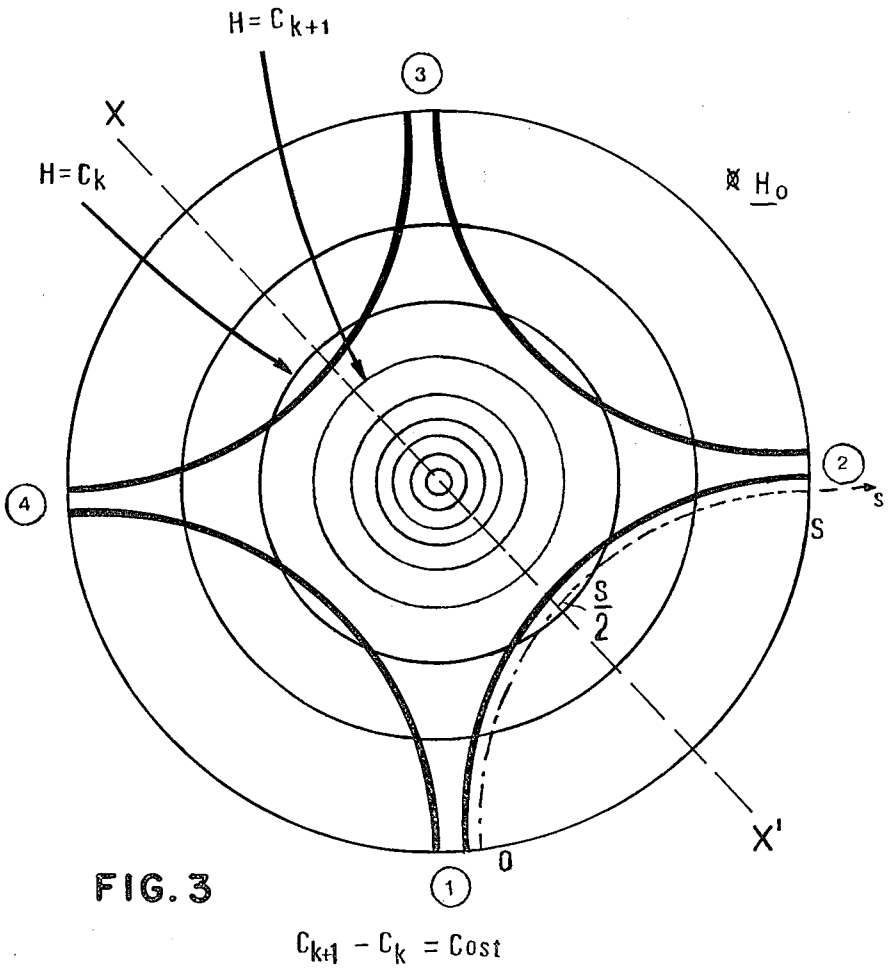
FIG. 3 shows, in a representation by horizontal surface lines, two magnetic fields spatially variable. adapted for a 4 gate-junction.
Figure 5A:
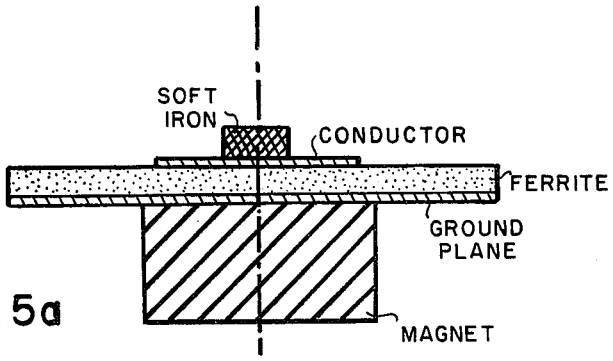

FIG. 5*a* shows a cross-section of the multigate junction according to FIG. 3, cut along line XX′ with the addition of a permanent magnet applied under the plane of the mass, and of a prism of soft iron applied over the radio frequency conductor.

Figure 5B:
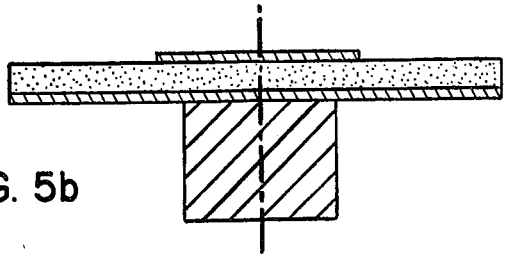

FIG. 5*b* represents a similar view as FIG. 5*a* without the soft iron prism and in which the permanent magnet is of reduced dimensions with respect to the radio-frequency conductor.

Figure 6:
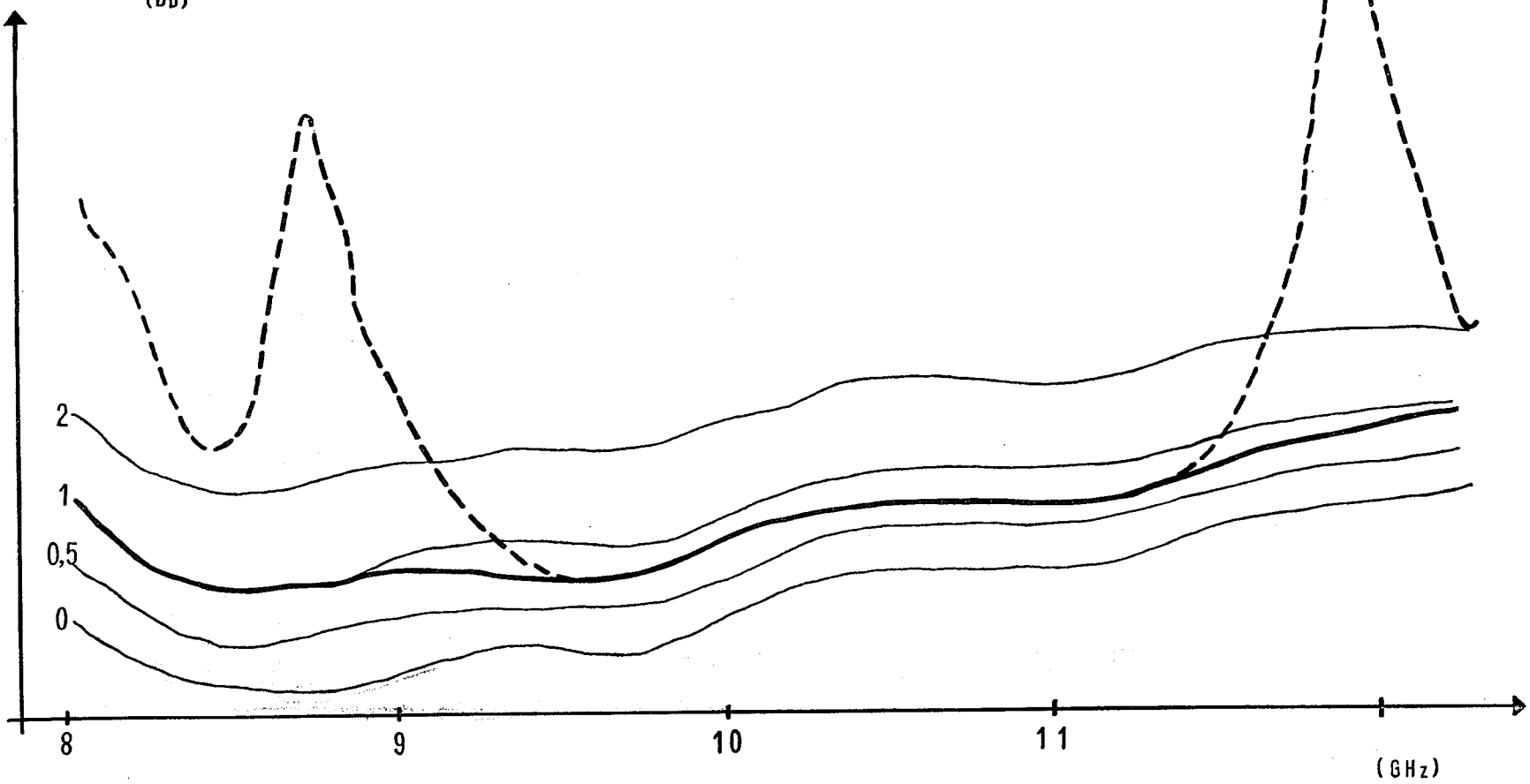

FIG. 6 illustrates in graph form the behavior of the insertion losses as a function of the frequency.

Figure 1A:
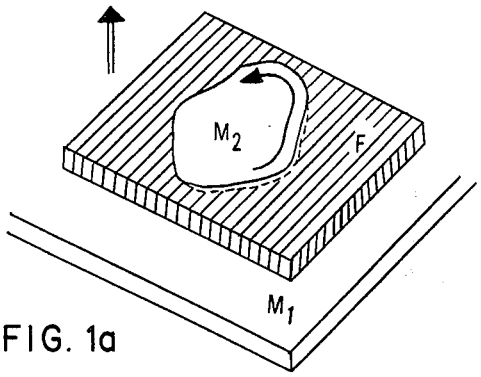
Figure 1B:
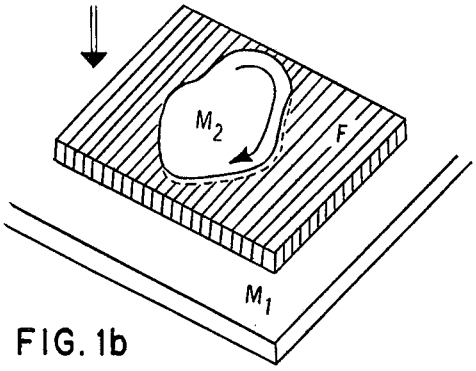

FIGS. 1 and 2 illustrate the physical principle on which the present invention is based. A slab or sheet or film of electrically conductive material $M_2$ is applied to a slab of ferrite material F which in turn is disposed upon a ground plane member or slab $M_1$. When a perpendicular magnetic force is applied to the assembly in an upward direction, current will flow around the outer periphery of $M_2$ in a counter-clockwise direction. When a perpendicular magnetic force is applied to the assembly in a downward direction, current will flow around the outer periphery of $M_2$ in a clockwise direction.

Figure 2A:
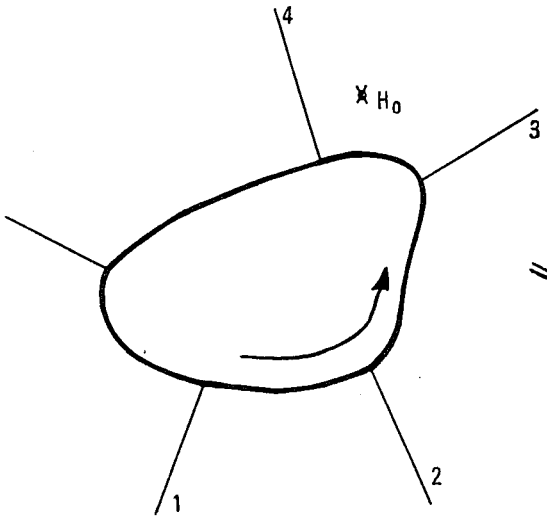
Figure 2B:
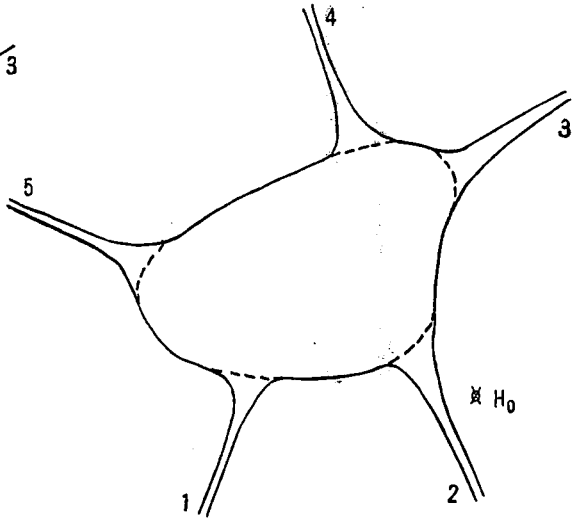

FIG. 2*a* shows a microstrip conductor without means for connecting to transmission lines 1, 2, 3, 4. FIG. 2b shows a microstrip conductor that is formed with extending tapered arms to accommodate connection to transmission lines 1, 2, 3, 4, 5.

With reference to the FIG. 3, it can be noted that the heavy lines represent the edge of the radio frequency conductor of a microstrip on ferrite. The thin lines represent the lines of horizontal surface on which magnetic force $H_0$ is constant. The dash and dot lines of FIG. 3 represent a coordinated curve *a* which extends along the path of the peripheral wave. In a particular application, when it is desired that the junctions under consideration to be electrically symmetrical, $\mu_{eff}$ eff$^{(s)}$ must be the same along lines, 3a 1-2, 2-3, 3-4, 4-1 in FIG. 3. This means to say that the magnetic force $H_0$ must have a spatial distribution endowed with the same symmetry as the radio-frequency conductor.

That is to say, the magnetic force in the conductor is non-uniform, and in effect, tapers as does the shape of the conductor.

Figure 4:
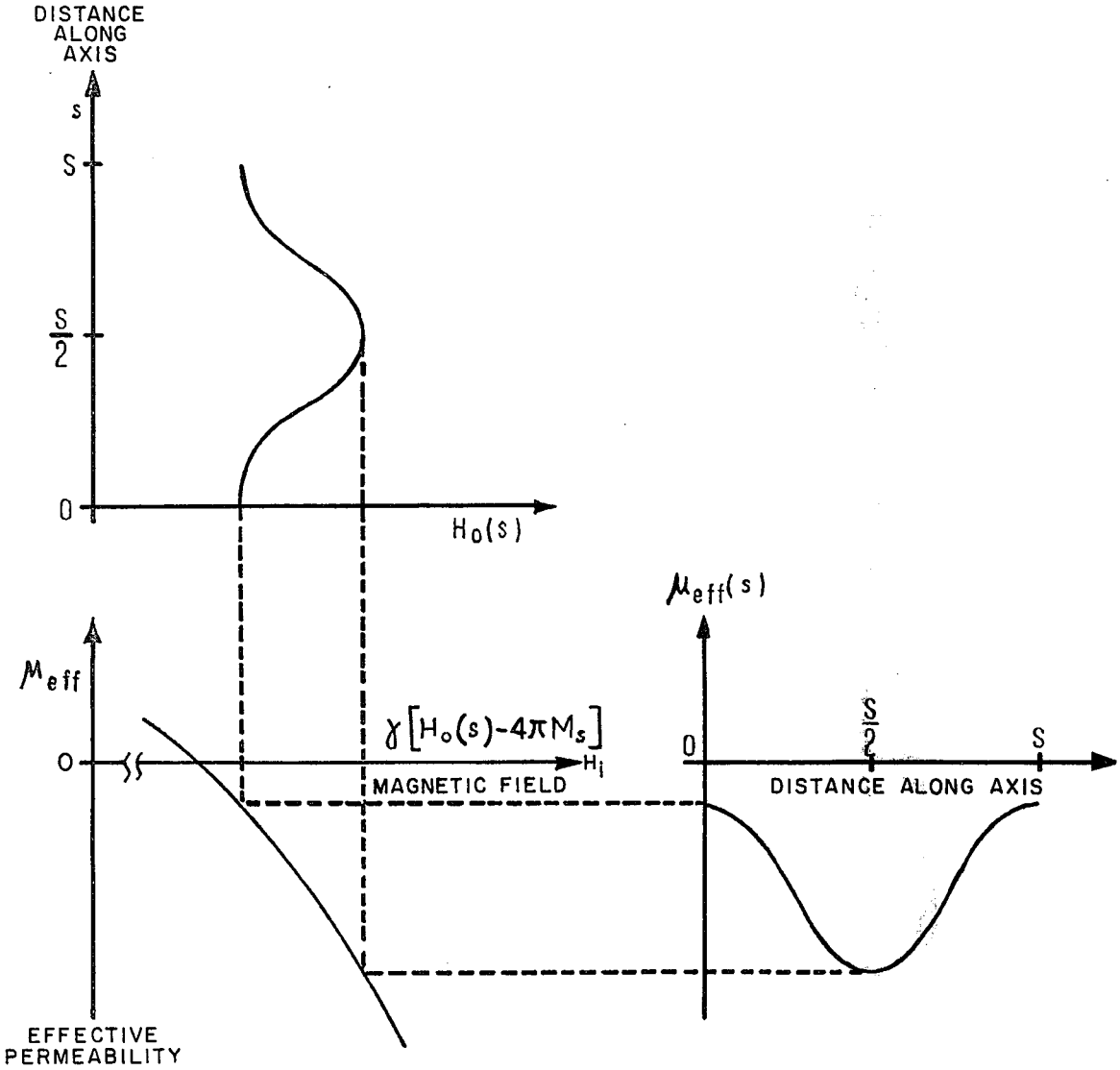
FIG. 4 illustrates three experimental graphs respectively representing the behavior or motion of the magnetic field along the axis of the microstrip, the effective permeability as a function of the magnetic field and finally the magnetic permeability along the axis of the microstrip.

In FIG. 4 it is shown that one goes from $H_0(s)$ to $\mu_{eff}$ (s) making use of the curve $\mu_{eff}$ vs. $H_i$ in the part $\mu_{ef}$-$_f$<0, that is to say where the peripheral waves are propagated with the smallest attenuation. $H_i = H_0 - \pi 4\ M_S$ is the internal magnetic field of the ferrite, and $M_S$ is the saturation magnetization. To show how, in practice, there can be used a magnetic field having a spatial variation of the indicated type, reference is made to FIG. 5. FIG. 5*a* represents the microstrip on ferrite shown in FIG. 3, cut along XX′, with the addition of the permanent magnet applied under the plane of the mass, and of a prism of soft iron applied above the radio frequency conductor. Another possibility of construction is shown in FIG. 5*b*, where the permanent magnet is smaller in size than the radio frequency conductor.

In FIG. 6, there is shown the effect of the magnetic tapering on the insertion loss in a three gate symmetrical microstrip circulator. The technique of execution is illustrated in the diagram in FIG. 5*a*.The outline curve shown by dashed lines in FIG. 6 shows the results obtained in the absence of magnetic tapering. There are seen in it two resonance peaks occurring near 8.8GHz and at 12GHz. There has been obtained experimental evidence that those are the results of the non-complete conversion of the excitation modes into peripheral modes. The heavy curve in FIG. 6 refers to the preceding situation, with the sole addition of a small cylinder of soft iron as in FIG. 5*a*. In this case, there can be seen a complete absence of resonance with a consequent widening of the useful functioning band.

The present invention has been described with reference to one of its preferred embodiment, but it is understood that it is possible to employ variations and modifications, without departing from the scope of industrial protection of the present invention.

What is claimed is:

1. A micro-wave multigate planar circulator coordinating the TEM (Transverse Electro-Magnetic) and the peripheral modes of wave propagation, comprising:
   - a member of ferro-magnetic material of substantially planar configuration and having a spatially non-uniform distribution of effective permeability;
   - a micro-strip conductor disposed on one side of said member, and formed of a layer of conducting material and having the configuration of a central body and at least three tapered arms extending from said body for connection to external transmission lines;
   - a ground planar conductor disposed on the opposite side of said member; and
   - means for producing non-uniform magnetic biasing disposed on one side of said ground planar conductor for effecting said spatially non-uniform distribution of effective permeability of said member and producing magnetic tapering zones in said body and extending arms.

2. a micro-wave multigate plane circulator as claimed in claim 1 wherein said non-uniform biasing means comprises a permanent magnet, the relative size of said permanent magnet being smaller than that of said micro-strip conductor.

3. A micro-wave multigate planar circulator as claimed in claim 1 wherein said non-uniform biasing means comprises a permanent magnet, said circulator further comprising a soft iron element disposed adjacent the outer surface of said micro-strip conductor, the relative size of said element being smaller than that of said conductor.

* * * * *